United States Patent [19]

Thorowgood

[11] 3,965,505

[45] June 29, 1976

[54] SLEEPING BAGS

[75] Inventor: Sydney William Thorowgood, Auckland, New Zealand

[73] Assignee: General Sports Manufacturing Limited, Auckland, New Zealand

[22] Filed: Dec. 17, 1974

[21] Appl. No.: 533,685

[52] U.S. Cl. ..... 5/343
[51] Int. Cl.[2] ..... A47G 9/00
[58] Field of Search ..... 5/343

[56] References Cited

UNITED STATES PATENTS

| | | | |
|---|---|---|---|
| 2,757,390 | 8/1956 | Miller | 5/343 |
| 3,460,170 | 8/1969 | Ozier | 5/343 |
| 3,510,889 | 5/1970 | Peterson | 5/343 |
| 3,639,931 | 2/1972 | McGuire | 5/343 |

*Primary Examiner*—Paul R. Gilliam
*Assistant Examiner*—Andrew M. Calvert
*Attorney, Agent, or Firm*—Wenderoth, Lind & Ponack

[57] ABSTRACT

A sleeping bag includes a first and a second panel joined one to the other along the edges thereof. Zip fasteners or the like are provided down the side edges and across the foot of the panel so that opposite edges of the sleeping bag can be joined to convert a sleeping bag sleeping two people into a sleeping bag sleeping one person.

4 Claims, 2 Drawing Figures

10
11
12
13
1
2
3
4
5
6
7
8
9

SLEEPING BAGS

BACKGROUND OF THE INVENTION

This invention relates to sleeping bags.

Sleeping bags are available which sleep one person, and sleeping bags are also available which sleep two persons, but these are disadvantageous in that a sleeping bag which sleeps two persons is not suitable for sleeping one person, particularly in a cold environment, and also a sleeping bag which sleeps one person is not suitable for sleeping two persons. To overcome this latter difficulty it has often been the practice to join two sleeping bags together along the side openings thereof by, for example, connecting one half of the zip fastener on one sleeping bag with one half of the zip fastener on the other sleeping bag, and also connecting the remaining halves of the two zip fasteners. This also is disadvantageous as the sleeping bags must in general be of similar design, and also this method of joining a pair of sleeping bags results in the zip fastener being positioned in the middle of the resulting sleeping bag.

SUMMARY OF THE INVENTION

It is therefore an object of the present invention to provide a sleeping bag which will obviate or minimise the foregoing disadvantages in a simple yet effective manner or which will at least provide the public with a useful choice.

Accordingly the invention consists in a sleeping bag comprising a first panel, a second panel substantially overlying the first panel and joined to the first panel along at least part of the edges thereof, and connecting means on or adjacent at least the side edges of the panels such that the side edges may be joined one to the other by the connecting means in a manner such that the second panel comprises an inner member, which inner member is positioned within an outer member formed by the first panel.

The invention consists in the foregoing and also envisages constructions of which the following gives examples only, and where specific integers are mentioned herein which have known equivalents in the art to which this invention relates, such known equivalents are deemed to be incorporated herein as if individually set forth.

BRIEF DESCRIPTION OF THE DRAWINGS

One preferred form of the invention will now be described with reference to the accompanying drawings in which.

DETAILED DESCRIPTION OF THE INVENTION

Figures 1, 2:
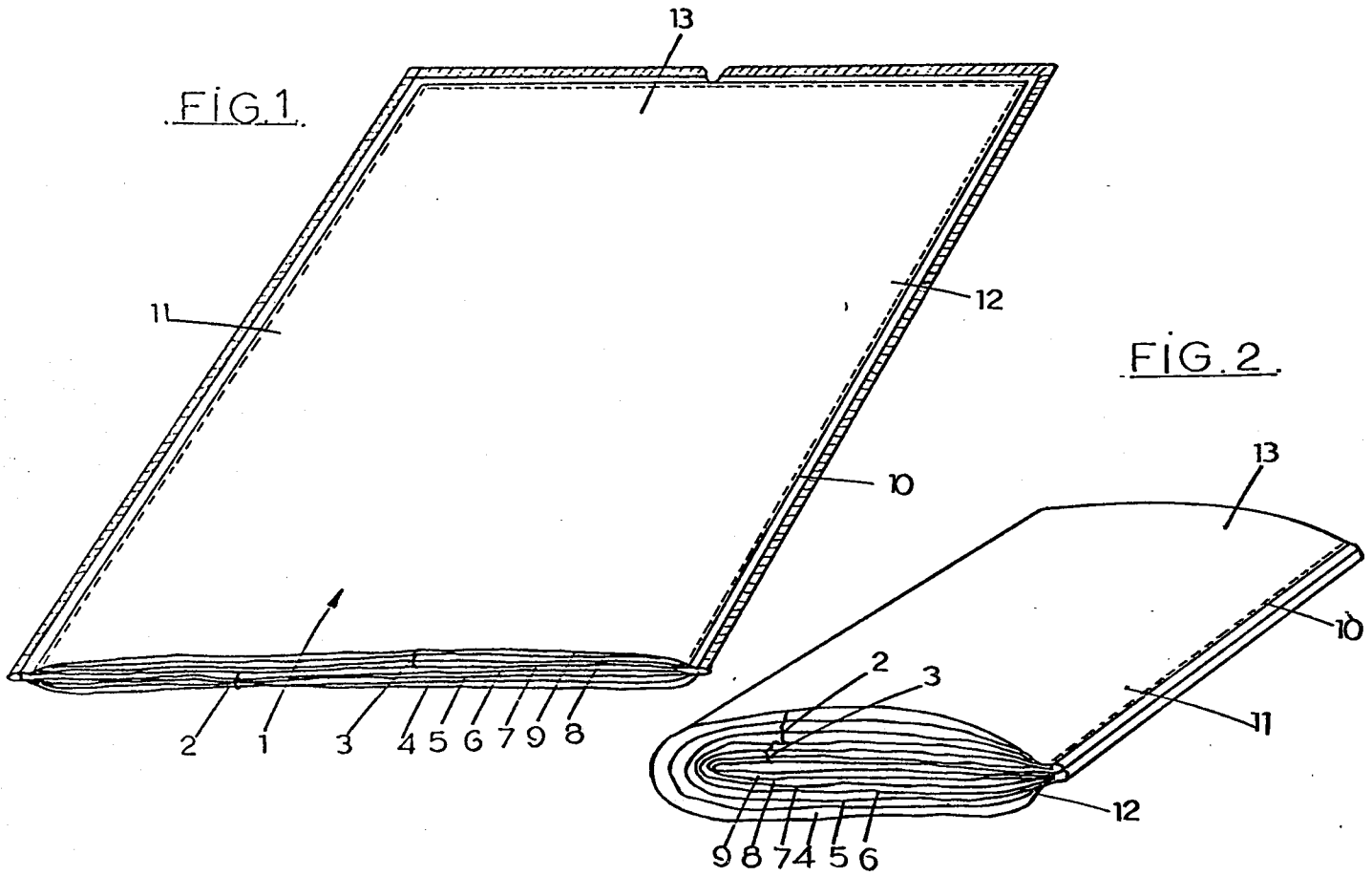
FIG. 1 is a perspective diagrammatic view of a sleeping bag according to the invention, the sleeping bag being shown in a first position.
FIG. 2 is a perspective diagrammatic view of a sleeping bag according to the invention in a second position.

In the preferred form of the invention a sleeping bag is provided as follows.

The sleeping bag 1 is provided by providing a first panel 2 and a second panel 3 joined to the first panel around at least part of the edges thereof, each panel being for example of a size such as to form when joined a double sleeping bag as shown in FIG. 1. Each panel is normally rectangular in shape.

Each panel 2 and 3 may be insulated, for example, in the known way, and one or both panels 2 and 3 may be waterproofed, in particular first panel 2 which when waterproofed should form the downward or underneath panel of the sleeping bag 1 in use. Such waterproofing may be provided, for example, by providing a layer 4 of nylon or similar fabric on the outer surface thereof. Thus the panel 2 may comprise the nylon or similar fabric surface 4, an insulating layer 5 of any suitable insulating material and a further layer 6 to cover the insulating layer 5 if necessary. The second panel 3 may also be similarly constructed with covering layers 7 and 9 if necessary covering an insulating layer 8.

In the second panel 3 if desired the insulating layer may be dispensed with, and of course when an insulating layer is provided the insulation may be of such a type that the covering layers 7 and/or 9 may not be necessary. The sleeping bag may then be constructed, for example, by providing the upper panel 3 and the lower panel 2, for example, by sewing the layers forming each panel around the edges thereof. In FIGS. 1 and 2 the panels are not shown as sewn along the forward facing edges which are intended to form the entrance to the sleeping bag, but this is for clarity only and normally sewing of these panels would be effected along these edges.

The panels 2 and 3 may then be sewn together, for example, by the sewing line 10 which passes down the sides 11 and 12 of the bag and across the foot 13. Of course an opening must be left to a user to get into the sleeping bag 1.

Connecting means are provided on or adjacent i.e. along at least the side edges 11 and 12 of the bag and preferably also along the foot 13 thereof, and the connecting means are preferably a zip fastener one half of which is connected down the side 12 of the sleeping bag and across one half of the foot 13 and the other half of which is positioned down the side 11 of the sleeping bag and across the other half of the foot 13. Thus the zip fastener may be positioned by the sewing line 10 also positioning the cloth part of the zip fastener between the bottom and top panels 2 and 3 before sewing.

Alternatively the sewing 10 may be effected by positioning the layers 4, 5, 6, 7, 8 and 9 or such of these as are being used, and the tab of the zip fastener and then effecting a single sewing around the sewn line 10.

It is apparent that the construction of the sleeping bag is such that the bag 1 may be folded, for example, longitudinally in a manner such that the side edges 11 and 12 of the sleeping bag are positioned adjacent one to the other. In this position the zip fastener may then be closed to join the adjacent side edges 11 and 12 and the two now adjacent halves of the foot 13. This has the effect of forming a sleeping bag one half of the width of the sleeping bag shown in FIG. 1, i.e. a sleeping bag as shown in FIG. 2.

In this second arrangement of the sleeping bag, the first panel 2 forms an outer member surrounding an inner member formed by the panel 3 as shown in FIG. 2.

Thus a person wishing to use a sleeping bag as shown in FIG. 2 would normally get into the sleeping bag in a manner such that he is surrounded by the inner member 3 i.e. the original top panel.

Suitable draw strings (not shown) may be provided along the top edge of the sleeping bag as desired.

The use of the invention is as follows.

In the preferred embodiment of the invention the sleeping bag may be used as a double sleeping bag, i.e.

such that two persons wishing to use the sleeping bag would sleep between the first and second panels, but if it is then desired to use the sleeping bag as a single sleeping bag, the side edges of the first and second panels are positioned one adjacent to the other and the connecting means, i.e. the zip fastener, could be closed. The person desiring to use the sleeping bag would then use the sleeping bag in substantially the known manner.

Thus it can be seen that a sleeping bag is provided which can be used as a single or double sleeping bag without the necessity of joining or separating single sleeping bags. This of course is advantageous and it is a particular advantage of the invention that the transition from a single to a double, or from a double to a single, sleeping bag may be effected in a speedy and simple manner.

I claim:

1. A sleeping bag comprising:

a first bottom panel;

a second top panel overlying said first panel;

said first and second panels being permanently joined at adjacent side and foot edges thereof, adjacent head edges of said first and second panels being unjoined to form an entrance to a double sleeping compartment between said first and second panels;

said first and second panels being foldable in half such that first of said permanently joined side edges are adjacent second of said permanently joined side edges, and such that said second top panel is folded to form a double-layer inner member and said first bottom panel is folded over said inner member to form an outer member; and connecting means, attached to at least said first and second permanently joined side edges, for selectively connecting said first and second permanently joined side edges when said panels are folded and for thereby forming a single sleeping compartment between the layers of said inner member.

2. A sleeping bag as claimed in claim 1, wherein said first panel and said second panel are substantially rectangular in shape, and said connecting means further comprises means for selectively connecting adjacent halves of the permanently joined panel foot edges when said panels are folded in half.

3. A sleeping bag as claimed in claim 1, wherein said connecting means comprises a zip fastener, each one half of which is positioned on one of said permanently joined side edges and on one half of the permanently joined foot edges of said joined panels.

4. A sleeping bag as claimed in claim 1, wherein at least said first bottom panel is substantially waterproof.

* * * * *